US007621379B2

(12) United States Patent
Miller et al.

(10) Patent No.: US 7,621,379 B2
(45) Date of Patent: Nov. 24, 2009

(54) ELEVATOR ASSEMBLY WITH EXTENDABLE SILL

(75) Inventors: Robin Mihekun Miller, Ellington, CT (US); Timothy P. Galante, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/565,382

(22) PCT Filed: Sep. 18, 2003

(86) PCT No.: PCT/US03/29827

§ 371 (c)(1),
(2), (4) Date: Jan. 20, 2006

(87) PCT Pub. No.: WO2005/035421

PCT Pub. Date: Apr. 21, 2005

(65) Prior Publication Data

US 2006/0243534 A1 Nov. 2, 2006

(51) Int. Cl.
*B66B 13/28* (2006.01)
*B66B 13/12* (2006.01)
*B66B 13/06* (2006.01)

(52) U.S. Cl. ..... 187/400; 187/330; 187/334

(58) Field of Classification Search ..... 187/308, 187/333, 334, 400; 14/69.5, 71.1, 71.5; 104/18–20; 105/21

See application file for complete search history.

(56) References Cited

U.S. PATENT DOCUMENTS 1,529,122 A * 3/1925 Fischer ..... 187/400
2,120,081 A * 6/1938 Alexander ..... 187/400
2,739,354 A * 3/1956 Pope ..... 187/400
3,327,650 A * 6/1967 Bridges et al. ..... 105/458
3,447,704 A 6/1969 Guilbert, Jr.
4,915,568 A * 4/1990 West ..... 414/401
4,926,975 A 5/1990 Morris
5,609,224 A 3/1997 Baggot

FOREIGN PATENT DOCUMENTS

DE 1110836 7/1961
FR 2219091 9/1974

(Continued)

OTHER PUBLICATIONS

Int'l Search Report, dated Sep. 18, 2003.

(Continued)

*Primary Examiner*—John Q. Nguyen
*Assistant Examiner*—Eric Pico
(74) *Attorney, Agent, or Firm*—Carlson, Gaskey & Olds PC

(57) ABSTRACT

An elevator (20) includes a sill (38) that extends out from underneath an elevator car (30) to bridge an operating gap (26) between the car (30) and a landing (24). When an elevator door (34) is aligned with a landing door (36), the sill (38) extends outwardly from the car (30) until the sill (38) makes contact with a landing structure (40). A locking mechanism (52) securely locks the sill (38) to the landing structure (40). In one example, once proper sill alignment and locking engagement occurs, a door moving mechanism (50) is released and the elevator (34) and landing (36) doors open.

22 Claims, 8 Drawing Sheets

FOREIGN PATENT DOCUMENTS

| | | | | |
|---|---|---|---|---|
| JP | 54104147 | A | * | 8/1979 |
| JP | 02163283 | A | * | 6/1990 |
| JP | 05132272 | A | * | 5/1993 |
| JP | 06032572 | A | * | 2/1994 |
| JP | 7157248 | A | | 6/1995 |
| JP | 8048481 | | | 2/1996 |
| JP | 9058955 | | | 3/1997 |
| JP | 11193192 | | | 7/1999 |
| JP | 2000118930 | | | 4/2000 |

OTHER PUBLICATIONS

Supplementary European Search Report for Application No. EP 03 75 9389 mailed Jul. 27, 2009.

* cited by examiner

ELEVATOR ASSEMBLY WITH EXTENDABLE SILL

FIELD OF THE INVENTION

This invention generally relates to an elevator with an extendable sill that bridges an operating gap between an elevator car and a landing. More particularly, this invention relates to a sill that extends outwardly underneath an elevator door to engage a landing structure.

DESCRIPTION OF THE RELEVANT ART

Elevator cars move upwardly and downwardly within a hoistway between landings. Sufficient running clearance must be maintained between the exterior of the elevator car and the hoistway walls to allow the car to move quickly and efficiently within the hoistway. If the running clearance is minimized, ride quality is decreased and car guidance system component wear is increased. If the running clearance is maximized, ride quality is improved but a large operating gap between the elevator car and a landing is created, which is undesirable.

One solution has been to use a pendulum car system. The pendulum car operates with an increased running clearance between the car and the hoistway walls, which provides a softer ride and decreases guidance system component wear. When the car reaches the selected landing, the car swings closer to the landing to reduce the operating gap between the car and the landing. One problem with this solution is that the lateral movement of the car creates occupant ride quality issues. Another disadvantage with this system is that a large amount of energy is required to move the car in a lateral direction. Further, if the system fails there is still a large gap between the car and the landing.

This invention provides an improved arrangement for bridging the operating gap between an elevator and landing while still maintaining sufficient running clearance and avoiding the other difficulties mentioned above.

SUMMARY OF THE INVENTION

In general terms, this invention is an extendable sill that bridges the operating gap between an elevator car and a landing. The sill extends outwardly from underneath an elevator car to contact a landing structure, such as a landing sill. A locking mechanism secures the sill to the landing structure preferably before elevator and landing doors open.

In one example, the locking mechanism includes an actuator that drives an engagement arm having a hook portion on one end. A pin is mounted to the landing structure. As the sill moves towards the landing structure, the actuator moves the hook portion into engagement with the pin. When a command is received to move to a different landing, the actuator releases the hook portion from the pin and the sill is returned to a retracted position.

Another example of a locking mechanism utilizes an electromagnet and solenoid actuator. The solenoid moves the electromagnet into contact with a magnetic target positioned on a hoistway wall. Optionally, solenoids with locking elements could also be used to hold the car in place within the hoistway.

In another example, the sill is moved horizontally and vertically to adjust for misalignment between an elevator car floor and the landing. The sill can be mounted to extend along a linear path and can be mounted to rotate downwardly from a position above the landing structure into engagement with the landing structure.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1A:
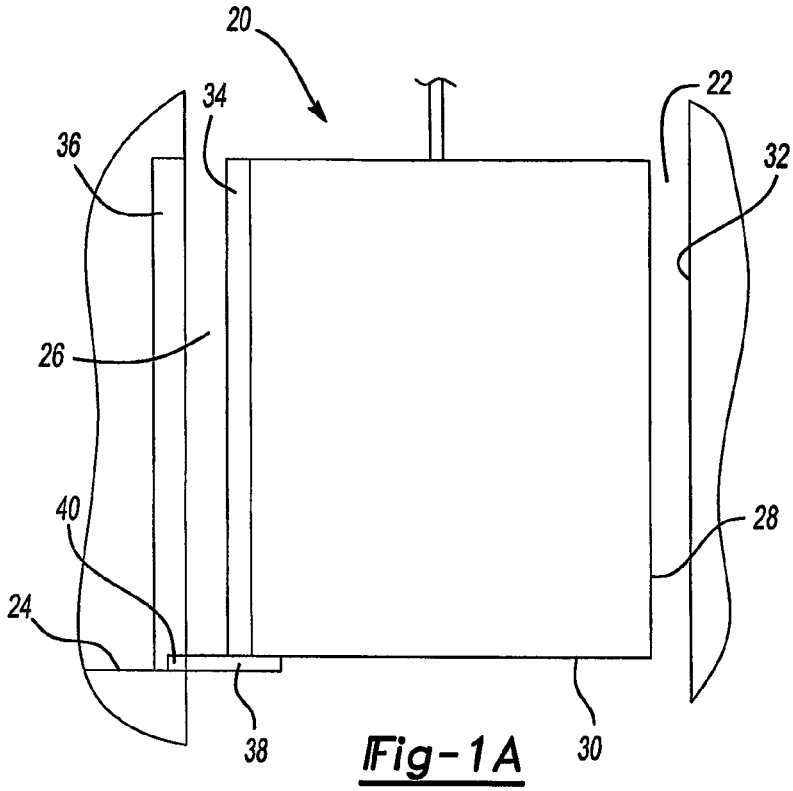
FIG. 1A schematically illustrates an elevational view of an elevator assembly mounted within a hoistway, incorporating the subject invention.
Figure 1B:
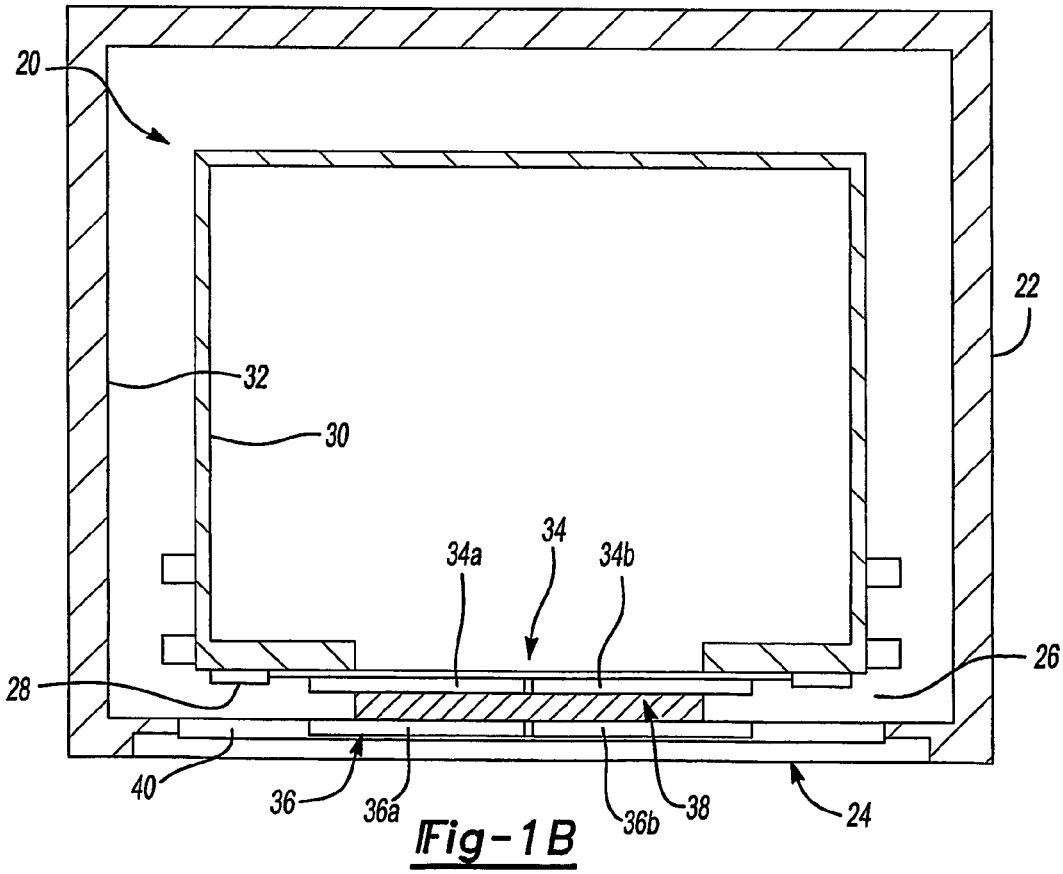
FIG. 1B schematically illustrates a cross-sectional view of the elevator assembly of FIG. 1A.

As seen in FIGS. 1A and 1B, an elevator assembly 20 is mounted within a hoistway 22 for movement between landings 24 (only one is shown). An operating gap 26 is maintained between an exterior surface 28 of an elevator car 30 and hoistway walls 32. The operating gap 26 is large enough to provide sufficient running clearance between the hoistway walls 32 and the elevator car 30 as the elevator assembly 20 moves within the hoistway 22 between landings 24.

The elevator car 30 includes an elevator door assembly 34 that moves between open and closed positions. When the elevator car 30 stops at one of the landings 24 to load or unload passengers or cargo, the elevator door assembly 34 aligns with a landing door assembly 36. A sill 38, supported by the elevator car 30, extends outwardly from the car 30 toward the landing door assembly 36 to bridge the operating gap 26 between the elevator door assembly 34 and the landing 24. The sill 38 extends out from underneath the elevator door assembly 34 and moves along a linear path to engage a landing structure 40, such as a landing sill. The sill 38 in this example comprises a plate member that presents a continuous unbroken surface such that there are no gaps between the elevator 34 and landing 36 doors.

Figure 2:
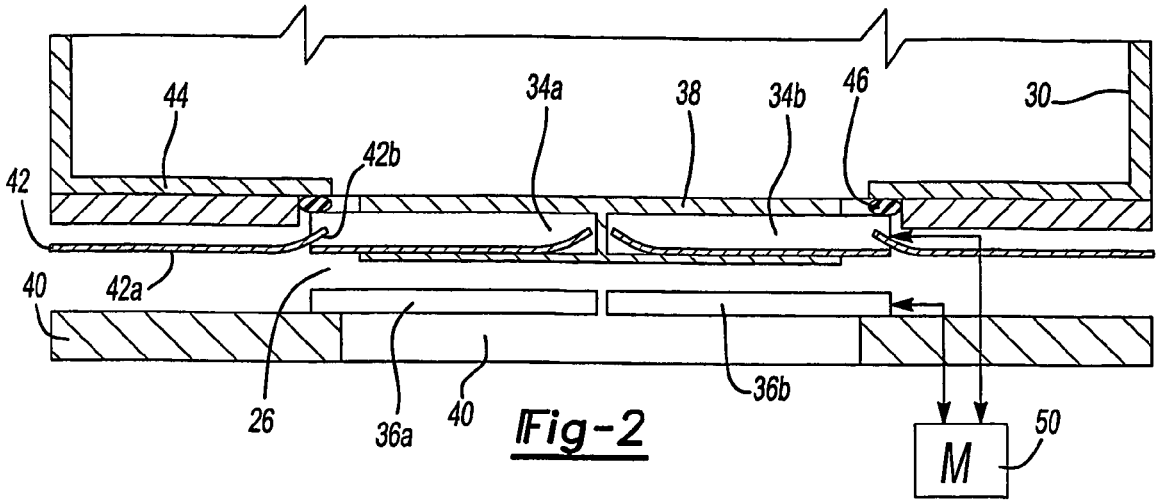
FIG. 2 schematically illustrates an elevator door assembly with an extendable sill that is aligned with a landing door assembly where the elevator and landing doors are in a closed position.

As shown in FIG. 2, the elevator door assembly 34 includes first 34*a* and second 34*b* doors that are supported on tracks 42 for movement relative to a car frame 44 between open and closed positions. A seal 46 is positioned between the car frame 44 and the doors 34*a*, 34*b* to reduce airborne noise levels within the elevator car 30. The landing door assembly 36 includes first 36*a* and second 36*b* doors that are supported for movement relative to a landing door frame structure 48.

A door moving mechanism 50 includes an interlock to open and close the car 34*a*, 34*b* and landing 36*a*, 36*b* doors together once the sill 38 is extended and locked into place. Any type of door moving mechanism and interlock as known in the art could be used. Further, the operation of door moving mechanisms and interlocks are well known and will not be discussed in detail.

When the elevator doors 34*a*, 34*b* are in a closed position, the seal 46 is compressed between the doors 34*a*, 34*b* and the car frame 44, and the sill 38 is in a fully retracted position underneath the doors 34*a*, 34*b*. This compressive force is applied due the configuration of the tracks 42. The tracks 42 include a first portion 42*a* that is generally straight and a second portion 42*b* that is non-parallel to the first portion 42*a*. The second portion 42*b* is preferably curved, such that the doors 34*a*, 34*b* are drawn inwardly against the car frame 44 to compress the seal 46. The seal 46 and associated track configuration in one example are described in greater detail in co-pending application entitled "Elevator Door Assembly With Compression Seal," herein incorporated by reference.

Figure 3:
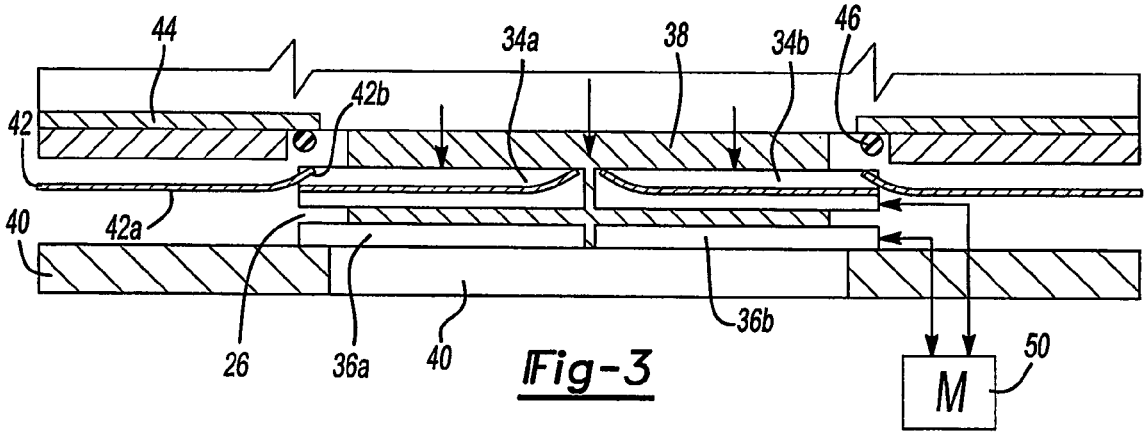
FIG. 3 is a similar to FIG. 2 but shows the sill in an extended position with the elevator and landing doors remaining in a closed position.

Once the car 30 is at the landing and the elevator doors 34*a*, 34*b* are aligned with the landing doors 36*a*, 36*b*, the sill 38 begins to extend outwardly from underneath the doors 34*a*, 34*b* toward the landing structure 40, as shown in FIG. 3. The sill 38 moves along a generally linear path that extends directly between the elevator doors 34*a*, 34*b* and the landing doors 36*a*, 36*b*. The doors 34*a*, 34*b* also move outwardly away from the car frame 44 along the second portion 42*b* of the tracks 42. The sill 38 preferably moves at a faster speed than the speed that the doors 34*a*, 34*b* move to uncompress the seal 46, to quickly bridge the operating gap 26.

Figure 4:
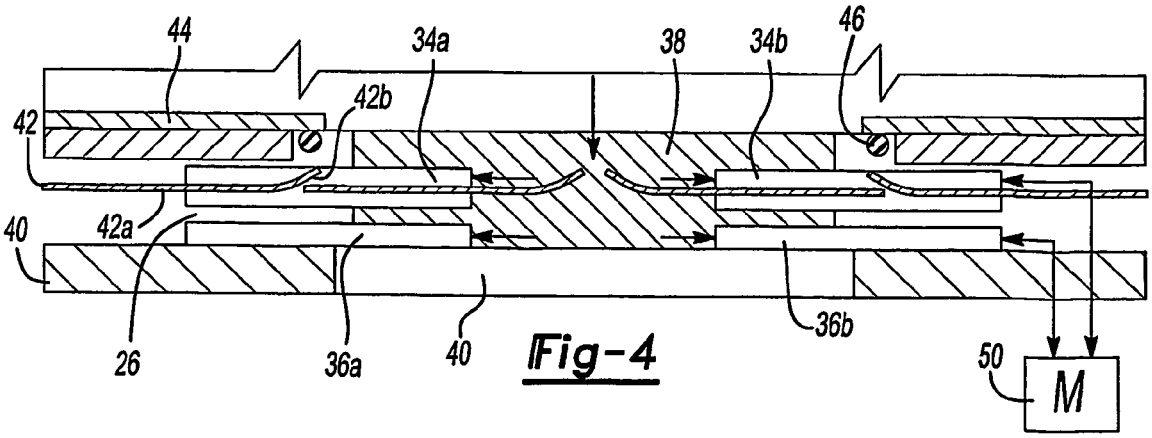
FIG. 4 is similar to FIG. 3 but shows the sill in an extend position with the elevator and landing doors in an open position.

In one example, door movement is dependent on the sill position. Once the sill 38 connects to the landing structure 40, the door operator or moving mechanism 50 is enabled for moving the doors to the open position. The sill 38 is locked across the door threshold and both the elevator doors 34*a*, 34*b* and landing doors 36*a*, 36*b* open, as shown in FIG. 4. The sill 38 remains locked to the landing structure 40 until a command is received to close the doors 34*a*, 34*b*, 36*a*, 36*b* and move the elevator car 30 to a different landing 24.

Figure 5:
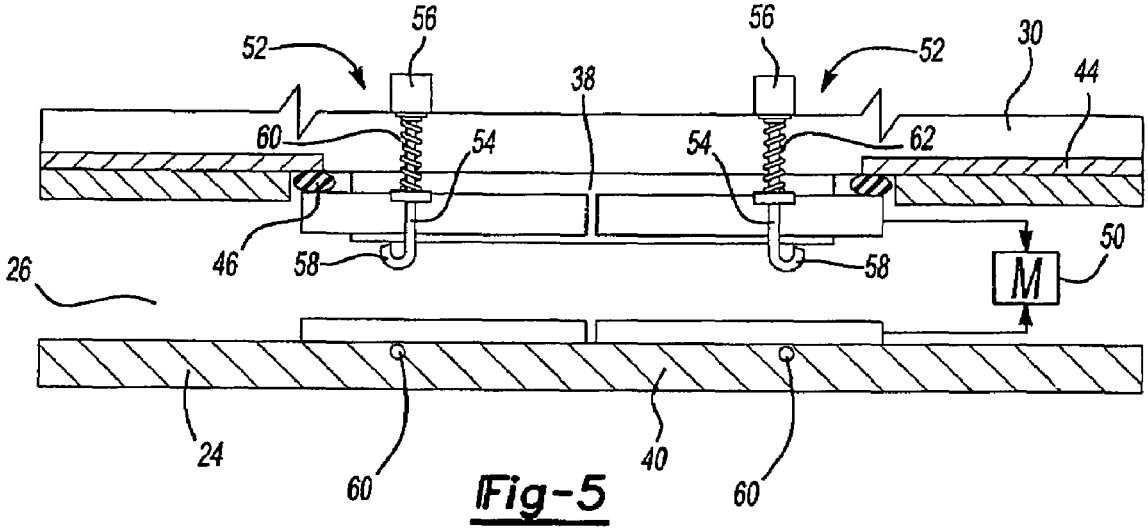
FIG. 5 schematically illustrates an elevator door assembly with the extendable sill and locking mechanism that is in an unlocked position.
Figure 6:
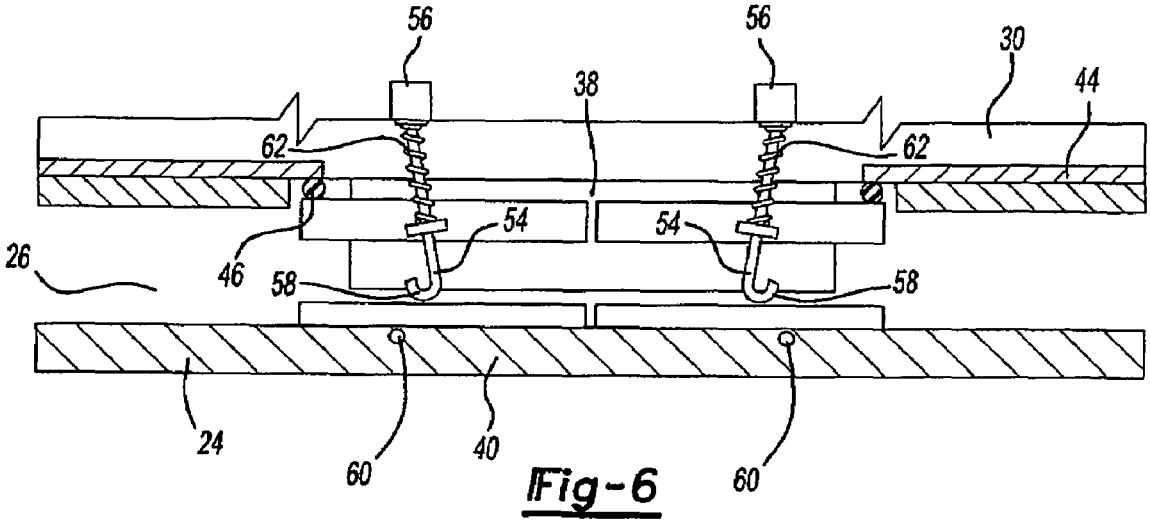
FIG. 6 is similar to FIG. 5 but shows the locking mechanism in an intermediate position between the unlocked and locked positions.
Figure 7:
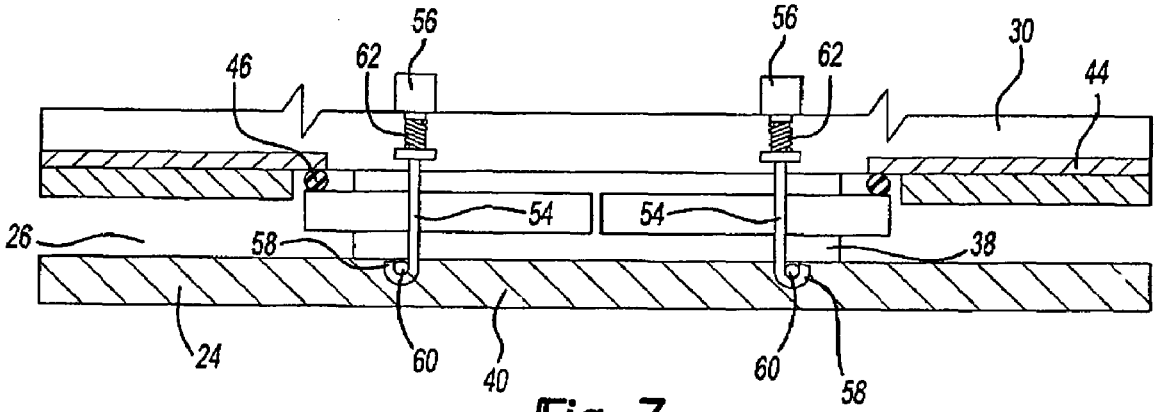
FIG. 7 is similar to FIG. 6 but shows the locking mechanism in the locked position.

An example of a locking mechanism for locking the sill 38 to the landing structure 40 is shown generally at 52 in FIGS. 5-7. The locking mechanism 52 includes an arm 54 mounted at one end to an actuator 56. An engagement hook 58 is formed or attached to an opposite end of the arm. The arm 54 is coupled with the sill 38 such that they move together. A pin 60 is mounted to the landing structure 40 (i.e., the landing sill). The actuator 56 moves the arm 54 such that the hook 58 is forced into engagement with the pin 60 (see FIG. 6). Once the hook 58 is securely locked into place with the pin 60, the sill 38 is in the fully extended and locked position, the door moving mechanism 50 is enabled, and the elevator doors 34*a*, 34*b* and landing doors 36*a*, 36*b* can now be opened (see FIG. 7). A resilient spring member 62 returns the arm 54 to a retracted, unlocked position (see FIG. 5) when the force provided by the actuator 56 is released.

This locking mechanism 52 operates in a manner similar to that of a sliding door locker. While a pair of locking mechanisms 52 is shown in FIGS. 5-7, it should be understood that a single locking mechanism 52 or additional locking mechanisms 52 could be used, depending on the size of the elevator and/or the elevator application.

Figure 8:
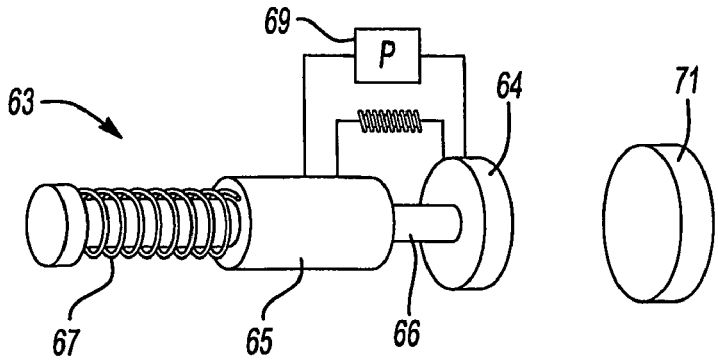
FIG. 8 schematically illustrates an example of a locking mechanism.
Figure 9:
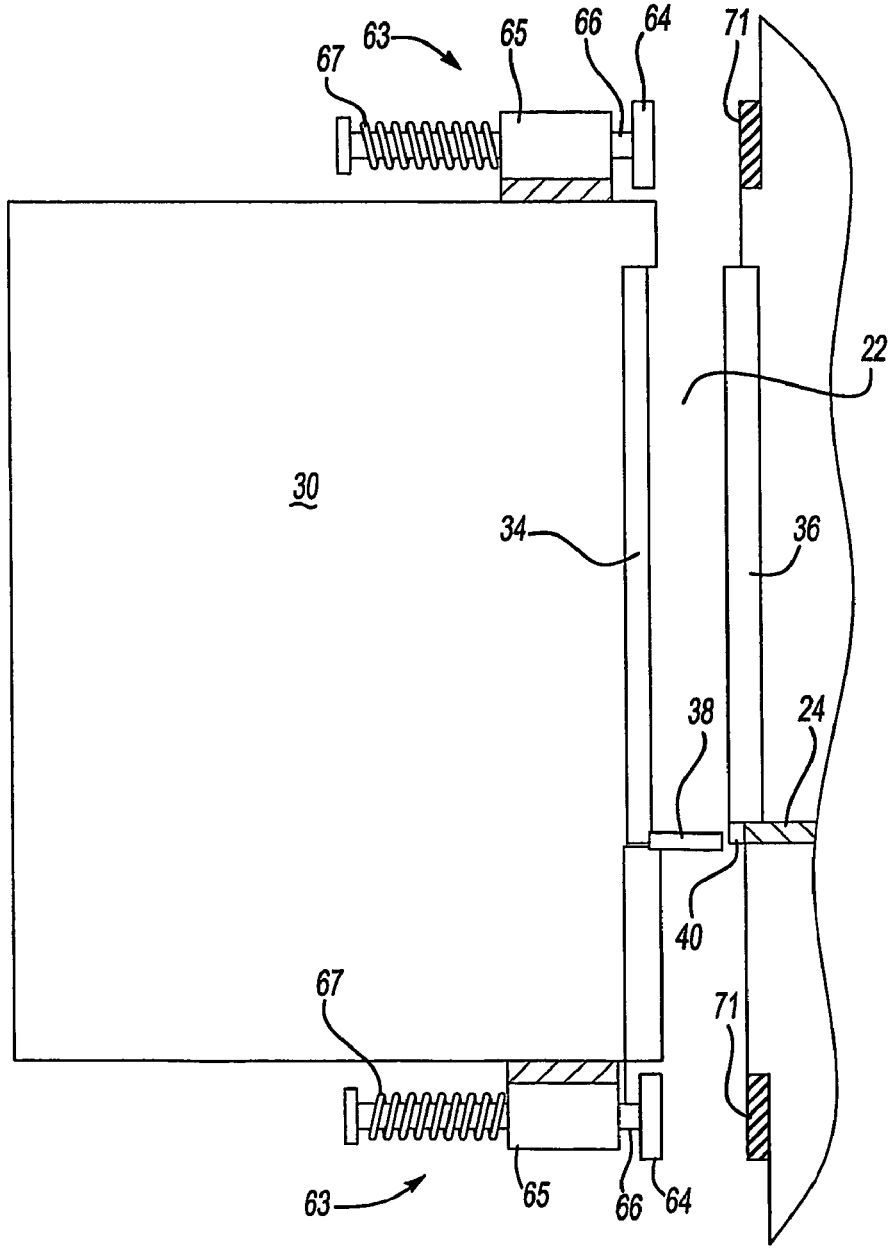
FIG. 9 schematically illustrates the locking mechanism of FIG. 8 incorporated into an elevator system.

An example of an actuator and locking mechanism 63 is shown in FIGS. 8 and 9. The actuator and locking mechanism includes an electromagnet 64 connected to an electrical power source 65 preferably comprising a solenoid. The electromagnet 64 is mounted for movement with a shaft 66 controlled by the solenoid 65. A spring 67 provides retraction for the shaft 66 and electromagnet 64. The actuator and locking mechanism would operate as follows. The car 30 stops and the electromagnet 64 and solenoid 65 are both actuated together by a cannon power source 69. The electromagnet 64 engages a steel target 71 mounted within the hoistway 22. This results in a drop in coil resistance, the solenoid 65 turns off, and the electromagnet 64 holds or locks the car 30 in place. Prior to departure, the electromagnet 64 turns off and the spring 67 retracts the shaft 66. A single actuator and locking mechanism 63 can be used, however, preferably a pair of actuator and locking mechanisms 63 are used, with one actuator and locking mechanism 63 being mounted on top of the car 30 and the other being mounted below the car. The sill 38 is preferably mounted for movement with the shaft 66 of the actuator and locking mechanism 63 mounted underneath the car 30. Optionally, a separate actuator can be used to control movement of the sill 38.

Figure 10A:
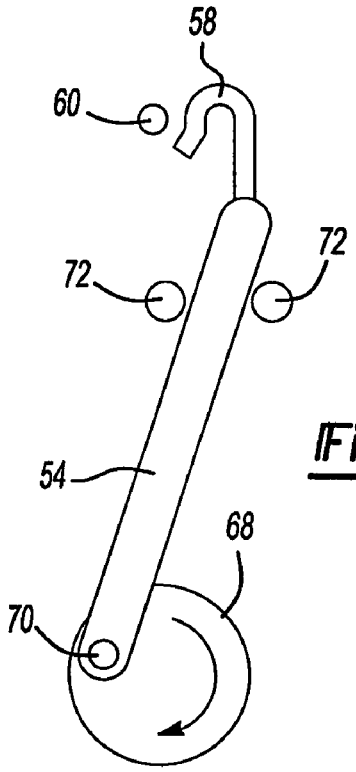
FIG. 10A schematically illustrates another example of a locking mechanism in the unlocked position.
Figure 11A:
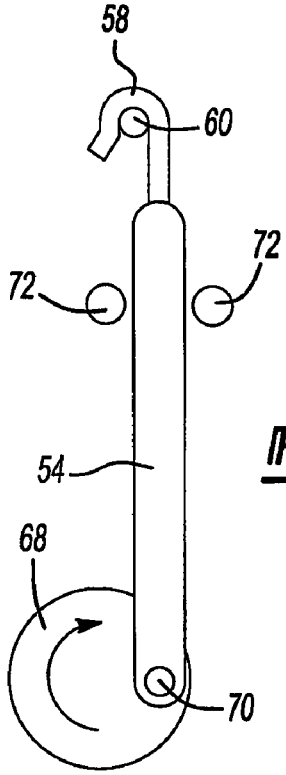
FIG. 11A is similar to FIG. 10A but shows the locking mechanism in the locked position.

Another example of an actuator 56 is shown in FIGS. 10A and 11A. In this configuration, the actuator 56 comprises an electric motor 68 having an output 70 that drives the arm 54. The arm 54 is positioned between a pair of guides 72 that cooperate with the arm to guide the arm 54 as the arm 54 moves between latched and unlatched positions. The motor 68 provides a rotational input force to drive the arm 54 in a first direction to unlatch the hook 58, as shown in FIG. 10A. The motor 68 provides a rotational input force to drive the arm 54 in an opposite direction to latch the hook 58 into engagement with the pin 60, as shown in FIG. 11A. In this example configuration, there is no need for the resilient spring 62, although one may be provided to ensure a return of the arm 54 in the event that the motor 68 fails.

Figure 10B:
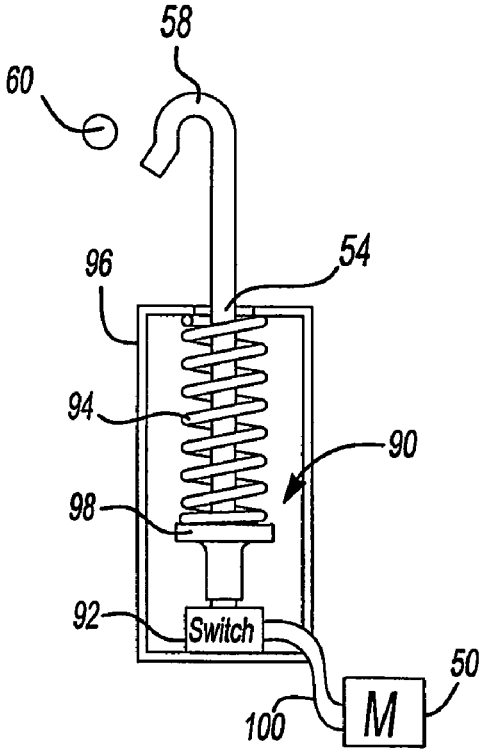
FIG. 10B schematically illustrates a return mechanism for the locking mechanism of FIG. 10A in the unlocked position.
Figure 11B:
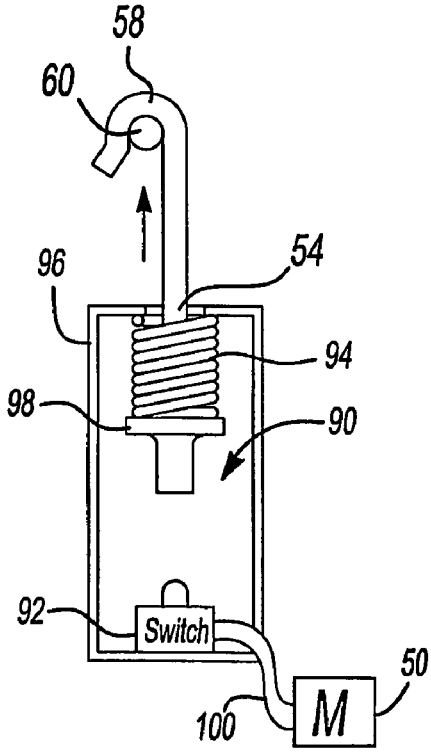
FIG. 11B is similar to FIG. 10B and schematically illustrates the return mechanism for the locking mechanism of FIG. 11A in the locked position.

A return mechanism 90 for the actuator 56 shown in FIGS. 10A and 11A is depicted in FIGS. 10B and 11B. The return mechanism 90 is incorporated into the hook area for feedback that the hook 58 is engaged and holding. The return mechanism 90 comprises a spring-loaded switch 92. A spring 94 reacts between a switch housing 96 and a base portion 98 associated with the arm 54. The switch 92 provides feedback 100 to the door moving mechanism 50. In the unlocked position (FIG. 10B), the spring 94 is extended, the switch 92 is closed, i.e., the base portion 98 is in contact with switch 92, and feedback 100 is given that the car 30 can be moved. In the locked position (FIG. 11B), the spring 94 is compressed, the switch 92 is open, and feedback 10 is given that the doors 34, 36 can be opened. When the motor 68 moves the arm 54 to unlock the hook 58 from the pin 60, the spring 94 acts to close the switch 92.

Figure 12:
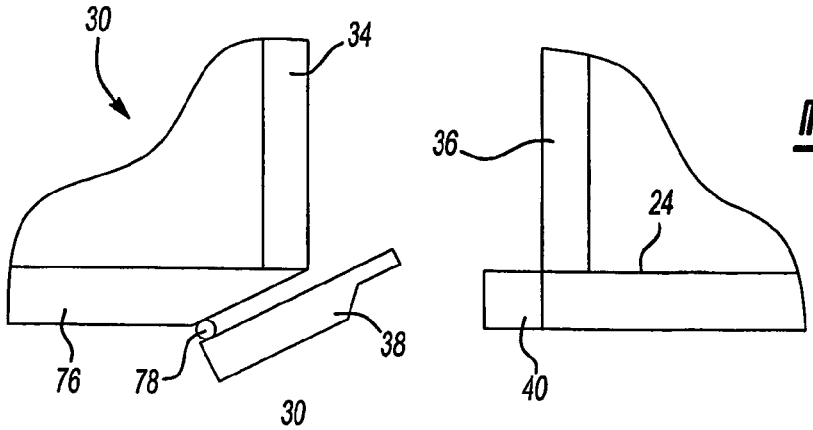
FIG. 12 schematically illustrates an example of a sill used to accommodate misalignment between the elevator car and landing.
Figure 13A:
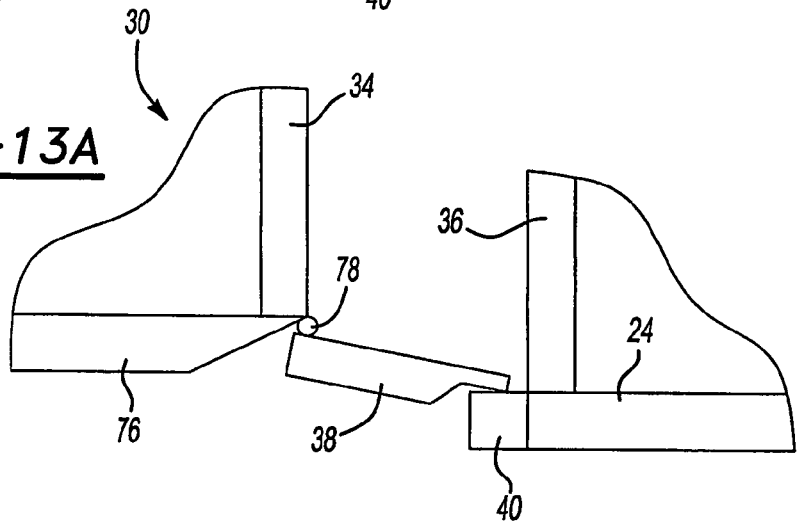
FIG. 13A is similar to FIG. 12 but shows the elevator car being higher than the landing.
Figure 13B:
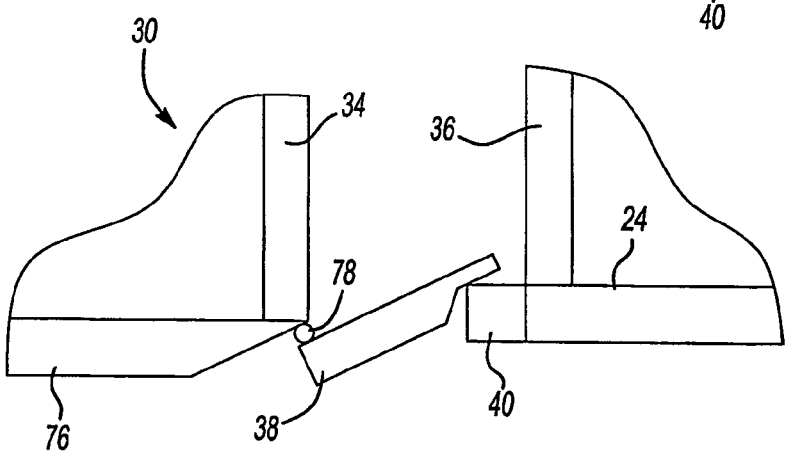
FIG. 13B is similar to FIG. 12 but shows the elevator car being lower than the landing.

The extendable sill 38 can also be used to accommodate misalignment between the elevator car 30 and the landing 24. As shown in FIG. 12, the sill 38 extends outwardly from underneath a car floor 76 towards the landing sill structure 40 supported by the landing 24. The sill 38 cooperates with a guide or a pivot 78 that forces the sill 38 to sweep upwardly, above the landing sill structure 40, prior to engagement with the landing sill structure 40. The sill 38 then sweeps down to contact the landing sill structure 40. This accommodates a configuration where the elevator car 30 is higher than the landing sill structure 40 (FIG. 13A) and a configuration where the elevator car 30 is lower than the landing sill structure (FIG. 13B).

Figure 14:
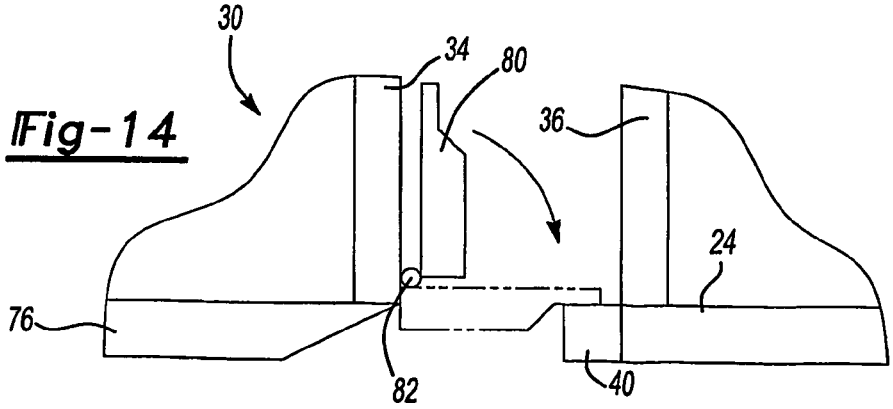
FIG. 14 schematically illustrates another example of an elevator car assembly incorporating the subject invention.

In another example, see FIG. 14, a sill 80 is mounted for movement with the elevator car 30. The sill is pivotally mounted to the car floor 76 with a pin 82 or similar component. The sill 80 rotates down to the proper location to engage the landing sill structure 40. Upon contacting the sill 80, the door operator or moving mechanism 50 releases to allow the doors 34, 36 to open.

Figure 15A:
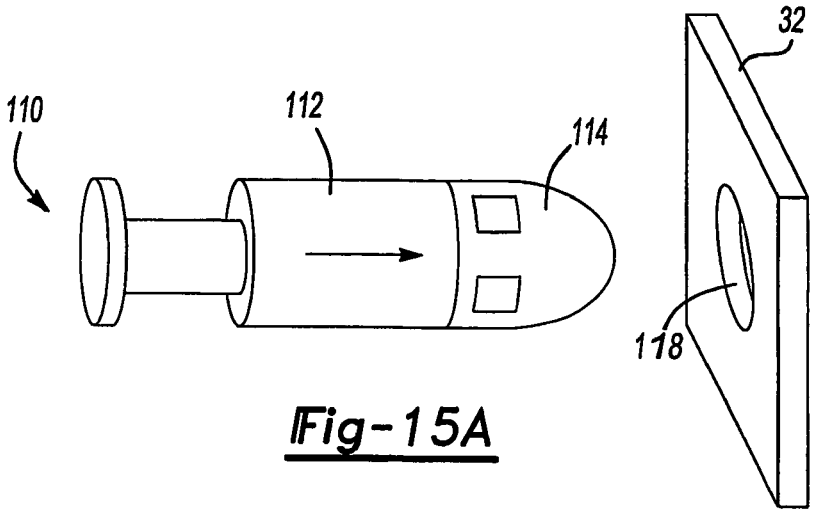
FIG. 15A schematically illustrates another example of an actuator and locking mechanism in the unlocked position.
Figure 15B:
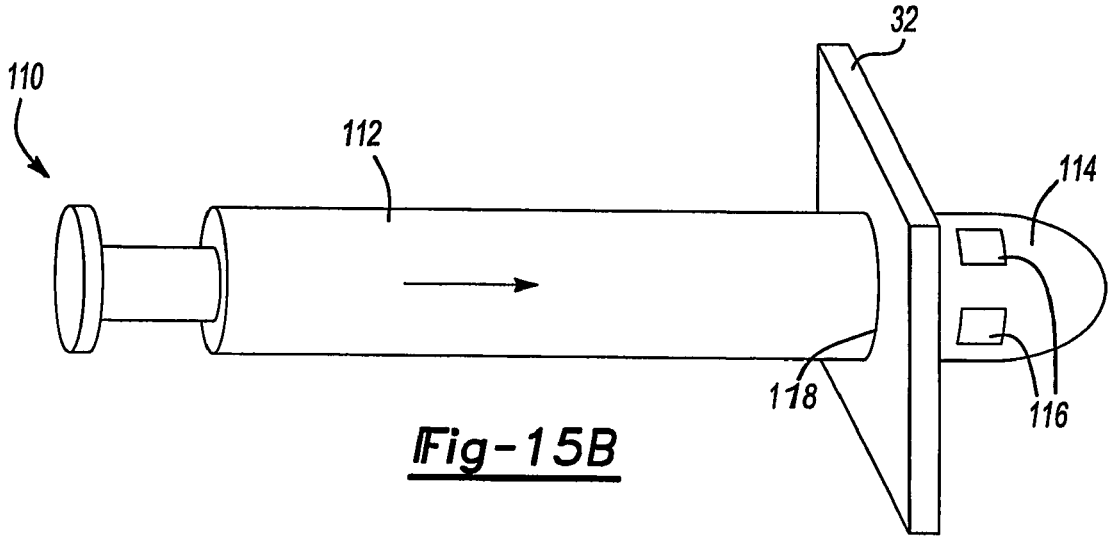
FIG. 15B illustrates the actuator and locking mechanism of FIG. 15A in an intermediate position.
Figure 15C:
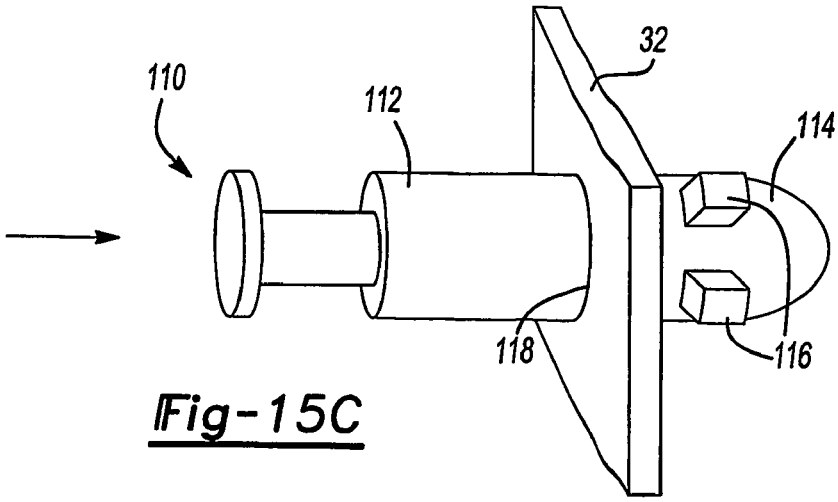
FIG. 15C illustrates the actuator and locking mechanism of FIG. 15A in the locked position.

Another example of an actuator and locking mechanism 110 is shown in FIGS. 15A-C. The actuator and locking mechanism 110 includes a solenoid 112 with an extendable rod 114. Mounted for movement with a distal end of the rod 14 are locking elements 116. When the car 30 lines up with the landing 24, the solenoid 112 pushes the rod 114 into a hole 118 formed with the hoistway wall 32. The locking elements 116 extend outwardly from the rod 114 to hold the rod 114 in place. The locking elements 116 can be spring-loaded to retract and latch automatically upon the rod 114 being inserted through the hole 118. The retraction operation could pull on an extension release while retracting the rod 114, in a manner similar to a ratchet release.

Figure 16A:
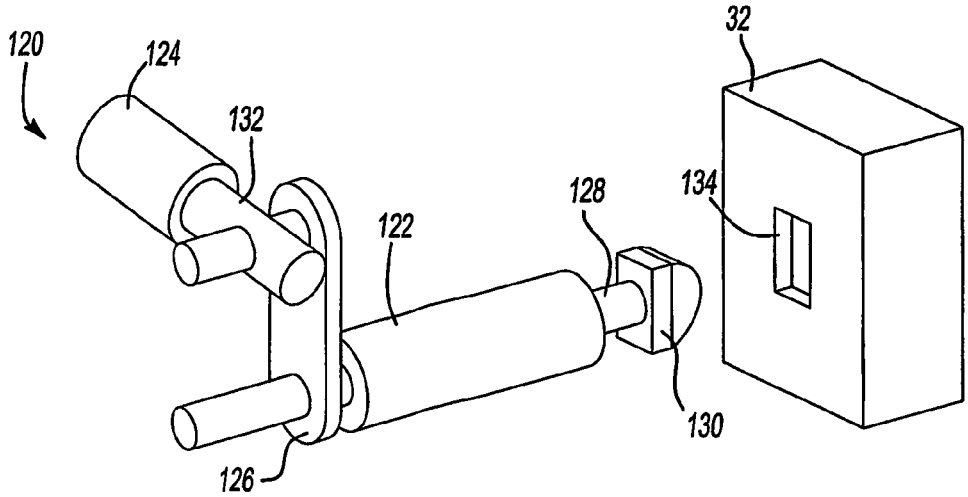
FIG. 16A schematically illustrates another example of an actuator and locking mechanism in the unlocked position.
Figure 16B:
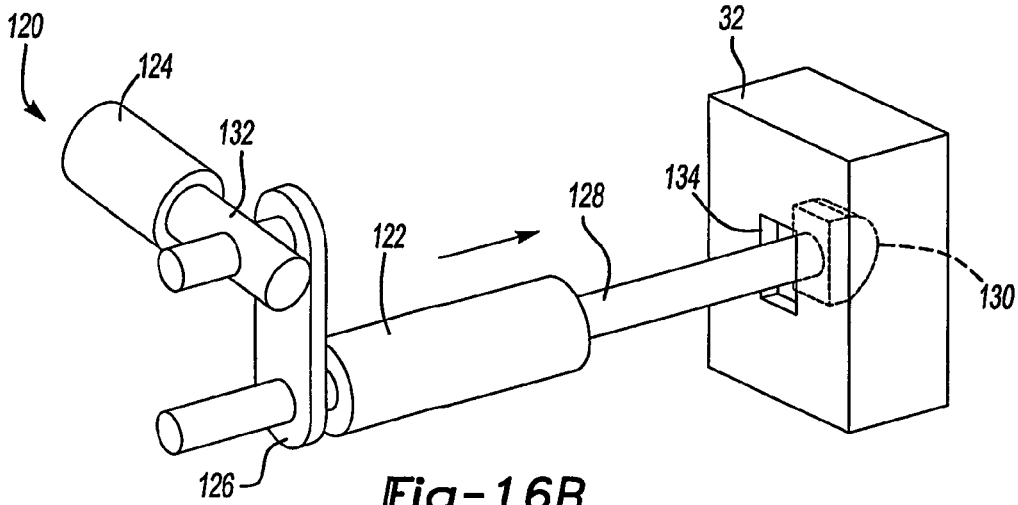
FIG. 16B illustrates the actuator and locking mechanism of FIG. 15A in an intermediate position.
Figure 16C:
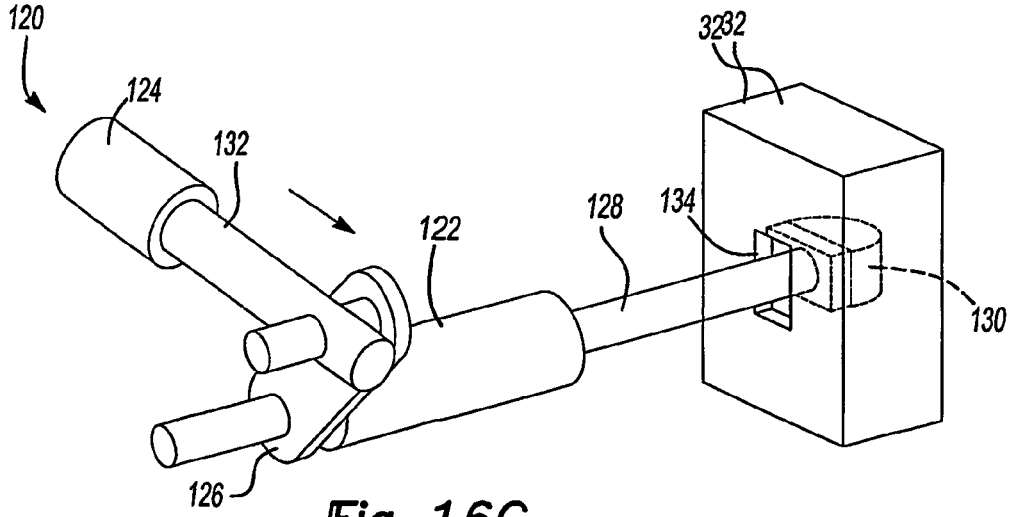
FIG. 16C illustrates the actuator and locking mechanism of FIG. 15A in the locked position.

Another example of an actuator and locking mechanism 120 is shown in FIGS. 16A-C. The actuator and locking mechanism 120 includes a first solenoid 122, a second solenoid 124, and a coupler 126 interconnecting the first 122 and second 124 solenoids. The first solenoid 122 includes a first shaft 128 with a locking element 130 mounted on a distal end. The second solenoid 124 includes a second shaft 132 that drives the coupler 126. The coupler 126 is mounted on the first shaft 128.

When the car 30 lines up with the landing 24, the first solenoid 122 pushes the first shaft 128 and locking element 130 through a hole 134 formed in the hoistway wall 32. A sensor (not shown) identifies when the shaft 128 reaches the end position. Then, the second solenoid 124 rotates the first shaft 128 via the coupler 126, which turns the locking element 130 ninety degrees (90°) to prevent removal of the first shaft 128 and locking element 130 from retracting from the hole 134, and to lock the car 30 in place. The first solenoid 122 will attempt to retract prior to releasing the door moving mechanism 50.

In each of the embodiments discussed above, the actuators and associated locking mechanisms could be located above, below, and/or on the sides of the elevator car. Further, the sill 38 can be moved by the same actuator as the locking mechanism or could be controlled by a separate actuator.

The unique, extendable sill 38 allows for quicker installation of the car assembly and provides more running clearance, which results in a softer ride and decreased guidance system component wear. Further, because the running clearance is greater, the gaps to the landing sills are also increased, which decreases aerodynamic pulse events generated as the elevator moves past landings. An additional benefit includes the opportunity to use a simplified door moving mechanism and interlock that does not require high accuracy vanes that restrict the amount of float that the guidance system can use. The subject invention can also be used with less initial landing alignment accuracy because the sill can be extended and adjusted without introducing a step at the landing sill to accommodate slight misalignments between the car and the landing. This decreases sensor and drive systems needs and improves landing speed.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. An elevator assembly comprising an elevator door mounted for movement relative to a car frame;

a sill supported by said car frame wherein said sill moves from a retracted position to an extended position and to decrease a space between said sill and a landing structure when said elevator door is initially aligned with a landing door; and a locking mechanism for selectively locking said sill to said landing structure near the landing door, a door moving mechanism that prevents the elevator door from moving from a closed position unless the sill is in the extended position and locked to the landing structure.

2. The assembly of claim 1, wherein said sill extends outwardly from underneath said elevator door along a generally linear path to engage a landing structure.

3. The assembly of claim 1, wherein said locking mechanism comprises an actuator, an arm having a hook portion, and a pin mounted to said landing structure wherein said actuator actuates said hook portion to selectively engage said pin to secure said sill to said landing structure.

4. The assembly of claim 3, wherein said actuator comprises an electric motor.

5. The assembly of claim 1, including an actuator and locking mechanism having an electromagnet mounted for movement with a shaft driven by a solenoid for selectively engaging a magnet target mounted to a hoistway wall to lock said car frame in position relative to said landing structure once said elevator door is aligned with said landing door.

6. The assembly of claim 1 including a track supporting said elevator door for movement between open and closed positions, said track including a first track portion and a second track portion that is non-parallel to said first track portion; and a seal positioned between said elevator door and said car frame wherein said elevator door applies a compressive sealing force against said seal as said elevator door moves from said first track portion to said second track portion.

7. The assembly of claim 6, wherein said sill moves at a first extension speed and said elevator door extends outwardly away from said car frame at a second speed slower than said first speed to release compression on said seal.

8. The assembly of claim 1, wherein said sill comprises a generally flat plate presenting a continuous unbroken surface that extends from the car frame to a landing structure.

9. The assembly of claim 1, wherein said sill extends outwardly from underneath a car floor and is movable along a linear path toward a landing structure and along a rotational path to automatically adjust for misalignment between said car floor and said landing structure.

10. The assembly of claim 1, wherein said sill is pivotally mounted to a car floor and pivots away from said elevator door to engage the landing structure.

11. The assembly of claim 1, including an actuator and locking mechanism having at least one solenoid with an extendable shaft and a locking element mounted for movement with said shaft wherein said solenoid inserts said locking element through an opening in a hoistway wall with said locking element subsequently moving from an unlocked position to a locked position to prevent relative movement between said car frame and said hoistway wall.

12. An elevator assembly comprising:

an elevator door mounted for movement relative to a car frame;

a sill supported by said car frame wherein said sill moves from a retracted position to an extended position and to decrease a space between said sill and a landing structure when said elevator door is initially aligned with a landing door;

a locking mechanism for selectively locking said sill to said landing structure near the landing door, wherein said locking mechanism comprises an actuator, an arm having a hook portion, and a pin mounted to said landing structure wherein said actuator actuates said hook portion to selectively engage said pin to secure said sill to said landing structure; and a door moving mechanism having a lock position where said elevator door and landing door are prevented from opening and a release position where said elevator door and landing door are allowed to move from a closed position to an open position wherein said door moving mechanism does not switch to said release position until said hook portion securely engages said pin and said sill is in the extended position.

13. A method for opening an elevator door assembly comprising the steps of:

aligning an elevator door with a landing door;

and to decrease a space between said sill and said landing structure;

locking the sill to the landing structure; and opening the elevator and landing doors subsequent to the locking and the extending of said sill.

14. The method of claim 13 including engaging a hook supported for movement with the sill to a pin mounted to the landing structure to lock the sill to the landing structure.

15. The method of claim 13 including positioning a seal between the elevator door and a car frame;

supporting the elevator door on a track for movement relative to the car frame between open and closed positions; and compressing the seal between the elevator door and the car frame as the door moves from a first track portion to a second track portion that is non-parallel to the first track portion.

16. The method of claim 15 including initially moving the elevator door and the sill in a first direction outwardly away from the car frame once the elevator and landing doors are aligned, continuing to move the sill in the first direction until the sill engages the landing structure, and subsequently moving the elevator door in a second direction parallel to the car frame after the sill is locked to the landing structure.

17. The method of claim 13 including unlocking the sill from the landing structure in response to a request to move the elevator door to a different landing door.

18. The method of claim 13 wherein the sill comprises a plate presenting a continuous unbroken surface and including moving the sill along a generally linear path extending from the elevator door to the landing door, and completely bridging an operating gap formed between the elevator and landing doors with the plate.

19. The method of claim 13, wherein the sill comprises a plate mounted to a car floor and including pivoting the plate away from the elevator door to engage the landing structure.

20. The method of claim 13 including vertically adjusting the position of the sill relative to the landing structure to accommodate misalignment between a car floor and the landing structure.

21. The method of claim 20, including simultaneously rotating the sill and moving the sill in a linear direction toward the landing structure.

22. A method for opening an elevator door assembly comprising the steps of aligning an elevator door with a landing door;

and to decrease a space between said sill and said landing structure;

locking the sill to the landing structure; and releasing a door moving mechanism only after the sill is securely locked to the landing structure and said sill is extended.

* * * * *